US008651534B2

(12) United States Patent
Finke et al.

(10) Patent No.: US 8,651,534 B2
(45) Date of Patent: Feb. 18, 2014

(54) LOCKING SYSTEM FOR DOOR LEAF INSTALLATIONS

(75) Inventors: Andreas Finke, Gevelsberg (DE); Ralf Höher, Gevelsberg (DE)

(73) Assignee: Dorma GmbH +Co. KG, Ennepetal (DE)

( * ) Notice: Subject to any disclaimer, the term of this patent is extended or adjusted under 35 U.S.C. 154(b) by 505 days.

(21) Appl. No.: 13/024,792

(22) Filed: Feb. 10, 2011

(65) Prior Publication Data

US 2011/0192090 A1 Aug. 11, 2011

(30) Foreign Application Priority Data

Feb. 10, 2010 (DE) ..... 10 2010 007 657

(51) Int. Cl.
*E05C 1/02* (2006.01)

(52) U.S. Cl.
USPC ..... 292/137; 292/138; 292/144

(58) Field of Classification Search
USPC ..... 292/137, 162, 144, 156
See application file for complete search history.

(56) References Cited

U.S. PATENT DOCUMENTS 6,264,252 B1 * 7/2001 Clancy ..... 292/196
6,688,656 B1 * 2/2004 Becken ..... 292/26
7,775,563 B2 * 8/2010 Liang et al. ..... 292/25
2009/0241611 A1 * 10/2009 Brisco et al. ..... 70/95
2010/0327612 A1 * 12/2010 Liebel et al. ..... 292/336.3

FOREIGN PATENT DOCUMENTS

DE 19837193 A1 3/2000
DE 102004060124 A1 6/2006

* cited by examiner

*Primary Examiner* — Carlos Lugo
*Assistant Examiner* — Mark Williams
(74) *Attorney, Agent, or Firm* — Cozen O'Connor

(57) ABSTRACT

A locking device for locking a leaf of a leaf installation has first and second locking elements with respective first and latching elements. The second latching element is located at an end facing the first latching element and capable of a latching operative engagement with the first latching element. The second locking element is stationarily disposed relative to the leaf installation. The first locking element is disposed with regard to the leaf to move correspondingly to a movement of the leaf, so that the first locking element is moved translationally into a locking position towards the second locking element and away from the second locking element into an unlocking position. One of the locking elements has an activating element operable to allow for the latching operative engagement between the latching elements in a blocking position and to prevent the latching operative engagement in a release position.

11 Claims, 5 Drawing Sheets

LOCKING SYSTEM FOR DOOR LEAF INSTALLATIONS

BACKGROUND OF THE INVENTION

1. Field of the Invention

The invention relates to a locking system for leaf installations, in particular to a locking system for sliding door installations.

2. Description of Related Art

Locking systems of the aforementioned species are known. A latching locking system for tilt windows is shown in the document DE 198 37 193 A1. A guiding pin, which serves as a latching element, is received in a translationally guided manner in an oblong hole of a corresponding longitudinal guide, and is furthermore attached to a scissor arm of a tilt fitting of an associated window leaf. At one end the oblong hole terminates in a terminal limitation, which has the shape of a circular hole, the diameter thereof being larger than the width of the oblong hole. The longitudinal guide is elastically configured. It is therefore possible for the guiding pin to be moved along the oblong hole and to be arrested in the circular hole, whereby the locking, respectively the leaf fixing position is achieved. The disadvantage is that the locking system is permanently active. Furthermore, the guiding pin permanently rubs within the oblong hole, which requires a higher expenditure of force, when moving the guiding pin in the longitudinal guide, and results in wear. In addition, the locking action can only be cancelled by moving the guiding pin out of the oblong hole. Unlocking for explicitly releasing the guiding pin and thus the tilt window is not provided.

A sliding door locking system is known from the document DE 10 2004 060 124 A1, in which an interlocking bell is disposed in a torque-proof manner with regard to a drive disc of a sliding door operator. An endless traction device of the sliding door operator is guided around the drive disc. The bell has recesses at a walling, which are preferably circumferentially configured and extend parallel to the axis of rotation of the bell. Perpendicularly to the axis of rotation, a locking bolt can be moved translationally towards the recesses and can be engaged in a respective one of the recesses. The bell is thereby prevented from rotating. This results in the circumstance that the drive disc either does no longer rotate and thus the sliding door leaves, which are operatively connected to the traction device, can no longer be moved. This solution is disadvantageous in that rotating parts need to be provided in order to accomplish the locking. An application with other door systems for example is almost impossible to realize. In addition, the structure is relatively large and complex.

SUMMARY OF THE INVENTION

It is an object of the invention to provide solutions to the above mentioned disadvantages.

An inventive device for locking at least one leaf of a leaf installation has a first locking element and a second locking element. At one end, the first locking element comprises a first latching element. At an end facing the first latching element, the second locking element comprises a second latching element. In the locking position, this second latching element is configured to operatively latch and engage with the first latching element. The second locking element is additionally adapted to be stationarily disposed with regard to the leaf installation. On the other hand, the first locking element is adapted to be disposed with regard to the at least one leaf such that, during a movement of the at least one leaf, the first locking element is moved correspondingly to said movement in such a way that the first locking element, depending on the direction of movement of the at least one leaf, is moved translationally into a locking position towards the second locking element, and is moved into an unlocking position away from the second locking element. This means, due to a movement of the leaf, the first locking element is likewise moved, whereas, with regard to the entire leaf installation, the second locking element remains at the same location. One of the locking elements comprises in addition an activating element, which, when being actuated allows for the latching operative engagement between the first latching element and the second latching element according to a blocking position, or, according to a release position, prevents said engagement. This means, the activating element effects arming or shutting off the thus configured leaf locking system. Translationally moving the first locking element allows for being able to incorporate the locking device into any type of leaf installation, which has a translationally moved part, which is moved along with the respective leaf, or which installation is otherwise capable of translationally moving along a part via the leaf movement. This solution is thus completely independent from the type of a possibly provided leaf actuator, which is capable of moving the respective leaf in at least one direction. This means, this solution is also applicable for fully manually operated leaf installations. In addition, this solution is easy to incorporate into leaf installations.

The first locking element is preferably configured to be stationarily mounted in the area of or in a reception groove of a guiding part, which is stationarily disposed with regard to the leaf installation or to the respective leaf. This arrangement allows for simply incorporating the second locking element. It is thereby possible to simply insert the second locking element into the reception groove where it is translationally movable. Then it may for example assume the function of a sliding member. This results in the advantage of limiting the required space for the thus configured locking arrangement to a minimum.

The first or the second latching element preferably has a latching projection, therefore the respective other latching element has a latching part corresponding to said latching projection. Suitable latching parts are a latching projection or a latching opening.

The latching part preferably comprises a first reach-through part, which has an opening that serves for the latching as will be explained in the following. Reach-through part means in this case, that the latching projection reaches through said latching opening for the purpose of locking said leaf. The latching opening is configured end-to-end in the first reach-through part. Furthermore, the opening is movable at an acute or right angle with regard to the translational path of movement of the latching projection in such a way that the latching opening is disposed in the release position so that the latching projection is movable along its translational path of movement through the latching opening. In the blocking position, the opening is then disposed such that the latching projection, as long as it passes through the latching opening in the blocking position, is prevented, at least to a certain degree, from moving in a direction away from the first latching opening into the direction of the locking element, and is thus in a latching operative engagement with the latching opening while engaging it from behind. Preferably the latching opening extends along the direction of movement of the second locking element, namely points into the direction of the latching projection such that the latter can move, to a certain degree, through the latching opening and thus pass through it. In the release position, the latching opening is disposed such that the latching projection, along its translational path of movement, is freely moveable and able to reciprocate through the opening.

Furthermore, the latching part preferably comprises a second reach-through part, which is disposed at a side of the first reach-through part facing the latching projection. Similarly to the first reach-through part the second reach-through part has an opening configured end-to-end with the second reach-through part. With regard to the second reach-through part, the opening is stationarily disposed such that the latching projection, along its translational path of movement, is freely moveable and able to reciprocate through the opening. The opening does not serve for locking, but instead it serves for example as an abutment for the first locking element. In the blocking position, the openings of the reach-through parts are thus disposed with regard to each other such that the latching projection, as long as it passes through both openings, is prevented, at least up to a predetermined degree, from moving in a direction away from the latching opening into the direction of the opening of the second reach-through part, and is thus in a latching operative engagement with the latching opening. In the release and blocking positions, the openings take up respectively different positions with regard to each other. This measure allows for configuring the release, respectively the blocking of the latching projection exclusively by two structures that are very simple and inexpensive to produce, for example by through-bores as openings.

Preferably the reach-through parts bear against each other. This circumstance presents the advantage that the second reach-through part can serve as an abutment for the first reach-through part and thus increases the locking effect of the above mentioned latching projection, respectively enhances the locking stability of the first locking element.

Preferably, the opening of the respective reach-through part, seen in the direction of movement of the latching projection, has an interior contour which is essentially complementary to the exterior contour of said latching projection.

The reach-through parts preferably each has one section that extends parallel to one another and are configured like a plate. The plate-shaped configuration of the reach-through parts, seen perpendicularly with regard to the direction of movement of the latching projection, allows for a very economical utilization of space.

If in addition the plate-shaped sections bear against each other, the second locking element, seen along the direction of movement of the latching projection, becomes very short and is thus space-saving.

The latching projection, at its end oriented towards the latching opening is configured preferably tapered, and even more preferred in the shape of a mushroom head, the tapering pointing towards the latching opening. It is thereby possible to push the latching projection likewise through the openings of the reach-through parts as far as to the aforementioned operative engagement, even if the parts are already in the blocking position. In addition, the latching projection may be configured such that the latching projection, while having to overcome the holding force, respectively the locking force generated by the operative engagement with the latching opening, is likewise movable into the opposite direction of movement and out of the latching opening. A leaf locking system including an overload protection can be realized with such a latching projection in a very simple and inexpensive manner.

The aforementioned activating element is preferably formed by an electromagnet, which, upon actuation, moves the first reach-through part into the release position, respectively the blocking position. The electromagnet offers the advantage of defined working positions (locking, unlocking) of the locking arrangement and, in addition, it is easy to adapt to the required holding forces, respectively locking forces by the energizing system thereof. Pulsed current may be utilized for example.

Preferably at least one of the locking elements, at a side oriented towards the respective other locking element, has an abutment for the respective other locking element. A limitation for the latching projection during its movement into the direction of a corresponding latching element can thus be realized in a very simple way.

The first locking element is preferably adapted to be stationarily disposed with regard to a guiding rail or slide channel of the leaf installation. In this case, the second locking element can be likewise accommodated in the guiding rail or slide channel and directly or indirectly translationally guided and be movable towards the first locking element and away from it. This circumstance allows to incorporate the second locking element in an elegant and, in the extreme case, completely invisible manner, while utilizing the anyway existing guiding rail or slide channel. Thus already existent components of door leaf installations are shared. Furthermore, both space-saving and visual advantages result therefrom, because the second locking element can be visually hidden.

The first locking element is preferably adapted to be stationarily disposed at or in a guiding rail or slide channel. This circumstance bears the advantage that appropriate attachment possibilities have to be provided only at this rail, respectively in this rail. In addition, no machining is necessary at the leaf or at other components of the leaf installation, which fact, on the one hand, facilitates the installation, respectively the retrofitting work, and on the other hand allows for a removal without leaving any visual trace.

An inventive leaf installation comprises at least one movable leaf, at least one guiding rail or slide channel with a reception groove, which rail or channel is stationarily disposed with regard to the leaf installation or to the at least one movable leaf, and has at least one of the above described locking devices.

The leaf installation preferably comprises at least one leaf configured as a swing leaf. Via a slide arm assembly, this leaf is operatively connected to a swing leaf operator, namely a swing leaf drive or a door closer. The leaf installation comprises a slide channel, in which a sliding member is translationally guided and accommodated, which sliding member in turn is freely rotatably articulated at the slide arm of the arm assembly. The first locking element may be a component of the sliding member or may replace the latter.

As an alternative or in addition, the leaf installation has at least one leaf configured as a sliding (door) leaf. Such leaves are generally suspended from carrying rails and/or guiding rails, which are disposed above the respective leaf, or guided along their path of movement. Within the scope of the invention, the carrying rail may thus serve to directly or indirectly guide of the second locking element, for example via a carriage which is operatively connected to the leaf. The above described locking arrangement is very easy to incorporate into sliding installations, such as sliding doors, folding leaf doors, partitioning walls or the like, and preferably is invisible for users.

BRIEF DESCRIPTION OF THE DRAWINGS

Further features and advantages of the invention will become apparent from the following description of preferred embodiments, in which.

DETAILED DESCRIPTION OF THE EMBODIMENTS

Figure 1:
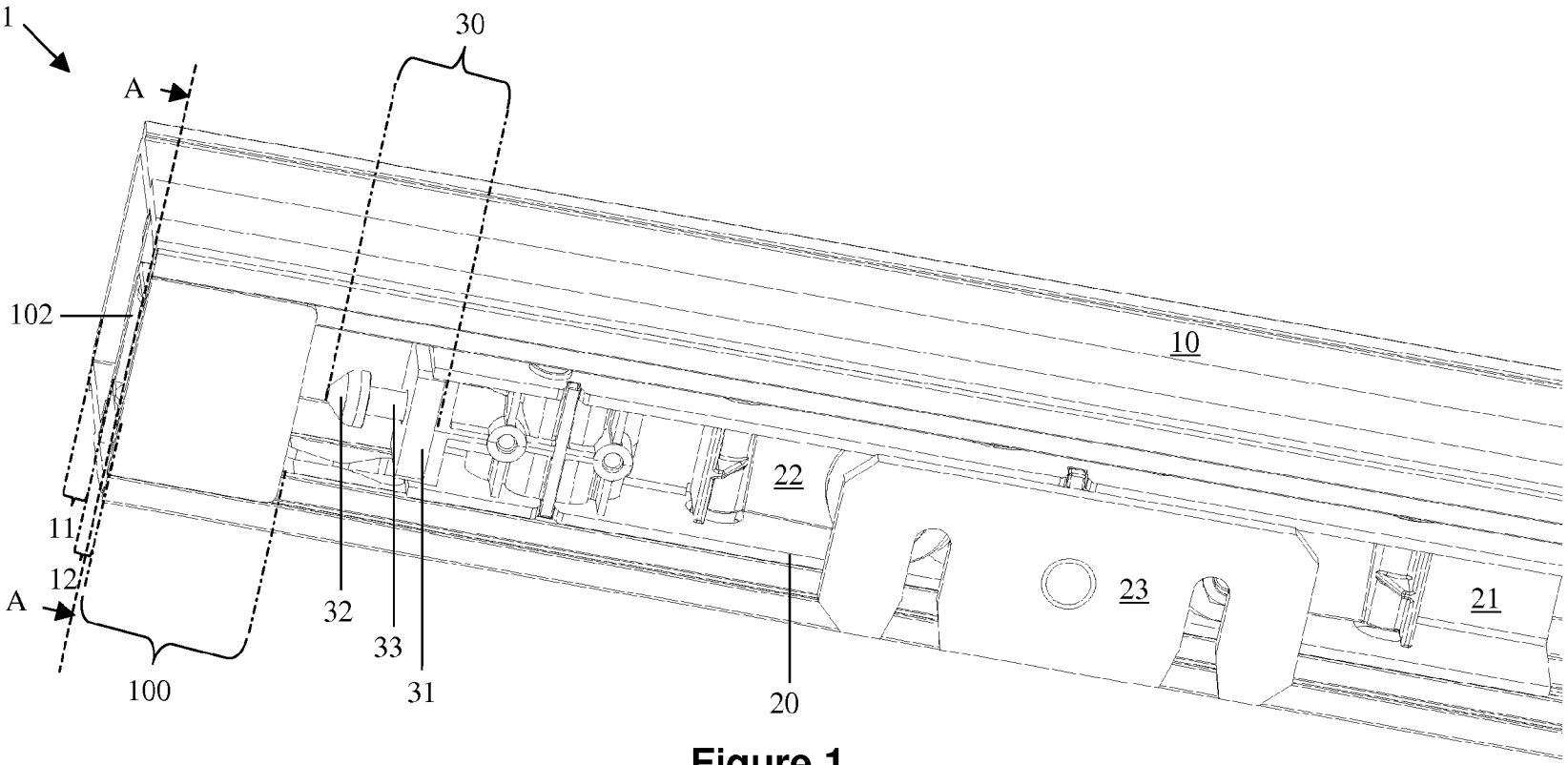
FIG. 1 is a locking arrangement according to an embodiment of the invention in an unlocking position.

FIG. 1 depicts a locking arrangement 1 according to an embodiment of the invention. The arrangement 1 comprises by way of example a carrying rail 10 of an exemplary sliding door installation. In the illustrated example, the sliding door installation utilizes a linear motor. In the illustrated example, the carrying rail 10, in a reception section 11, serves to accommodate a stator of the linear motor. Another reception section 12, which is separately configured from the reception section 11, mainly serves to accommodate carriages 20 of a sliding leaf in a guided manner. The sliding leaf is guided and accommodated in the carrying rail 10 via carriages 20.

For this purpose and by way of example, the carriage 20 has a reception profile 21, which is open to the bottom, i.e. in the direction of the leaf. This opening serves to introduce a respective catch 23, which operatively connects the reception profile 21 to the leaf and drives it along. A rotor 22, which in the illustrated example has a series of permanent magnets, is inserted into the reception profile 21. In a known manner the rotor 22 is in magnetic interaction with the stator.

In one embodiment, at the left end of the carriage 20, as shown in FIG. 1, respectively the reception profile 21 thereof, a first locking element 30 is stationarily mounted. Preferably, the locking element 30 is fitted to a frontal side of the profile 21 or into it by an abutment section 31. At the side facing away from the profile 21, a shaft 33 adjoins the abutment section 31, a preferably mushroom head-shaped latching projection 32 being configured at the free end of the shaft. This means the latching projection 32 tapers in the direction of the free end of the shaft. The shaft 33 has a smaller diameter than the maximum exterior diameter of the latching projection 32. The abutment section 31, the shaft 33 and the latching projection 32 are attached to each other or are partially or totally configured as one piece.

A second locking element 100 is also preferably located in the area of the left frontal side of the carrying rail 10. The locking element 100 has an attachment section 102, which is for example clampingly accommodated in the carrying rail 10, respectively in the reception section 12 thereof. However, all other attachment possibilities, such as screwing, latching, welding, gluing, and the like are conceivable.

Figure 2:
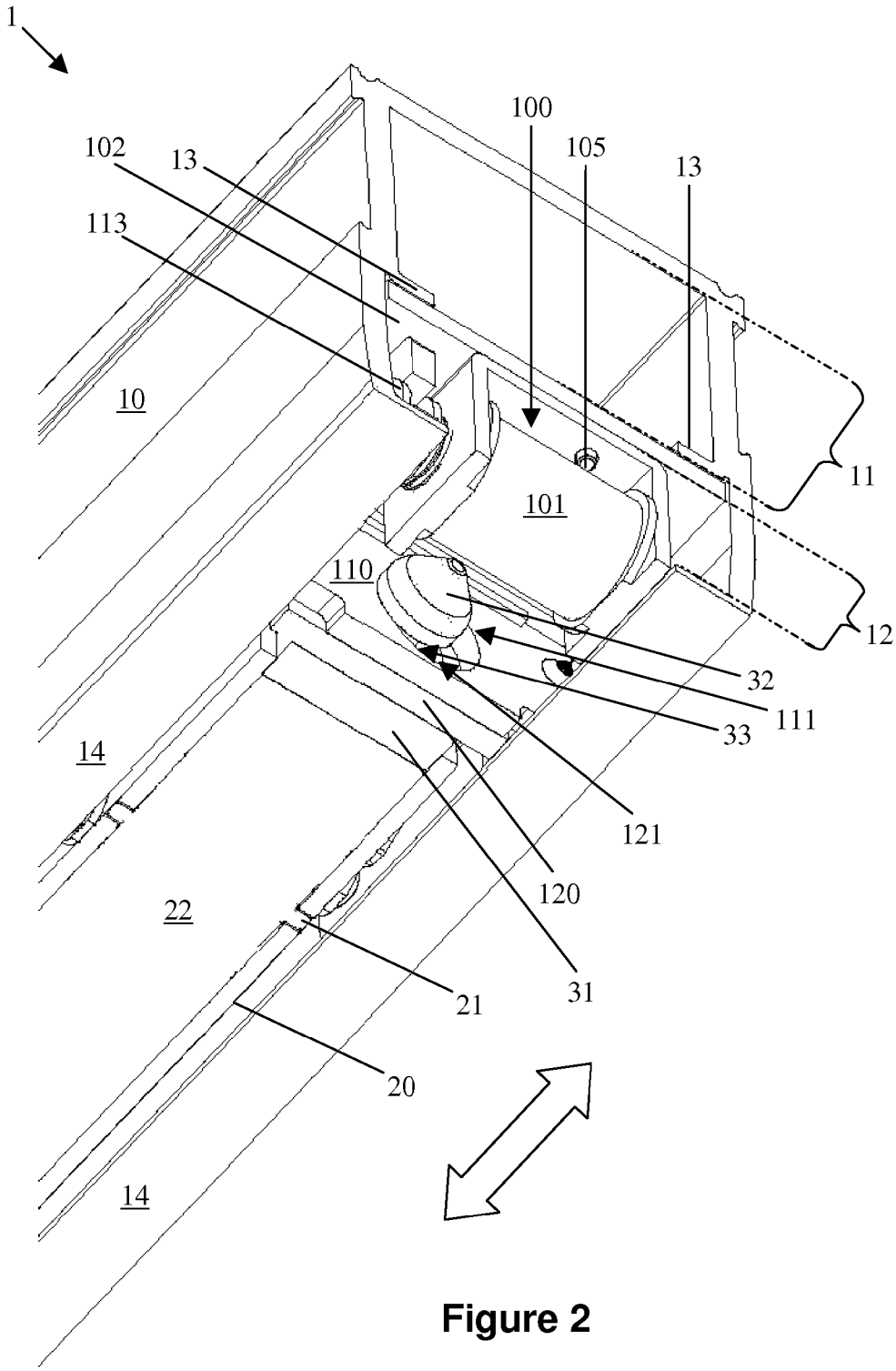
FIG. 2 is the locking arrangement of FIG. 1 in the locking position and in a section along a line A-A in FIG. 1.

FIG. 2 shows the locking arrangement 1 of FIG. 1 in a section along a line A-A of FIG. 1.

The locking element 100 comprises two so-called reach-through parts 110, 120. The functioning of these parts will be explained later in detail. The reach-through part 110 has a preferably centrally located opening 111, which in the illustrated example, is configured as a circular through-hole, and extends along the direction of movement of the latching projection 32, namely in the present case along a longitudinal extension of the carrying rail 10, respectively of the profile 20. The reach-through part 110 is translationally and movably guided perpendicular to the direction of movement of the latching projection 32 and the carriage 20, i.e. diagonally to the bottom right in FIG. 2.

At an end facing away from the latching projection 32, the locking element 100 furthermore has an activating element, in this case, an electromagnet 101. The electromagnet 101 magnetically cooperates with a partially visible armature plate 113 of the reach-through part 110. The electromagnet 101 is disposed such that, when energized, it pulls the armature plate 113 diagonally towards the bottom right perpendicular to the direction of movement of the latching projection 32, respectively along the direction of movement of the reach-through part 110.

The armature plate 113 is attached to the reach-through part 110, and preferably is integrally configured with it. Reach-through part 110 and armature plate 113 preferably comprise an angle of approximately 90°. This means, the reach-through part 110 is moved diagonally to the bottom right, as soon as the electromagnet 101, when being energized, pulls the armature plate 113.

Mounting of the locking element 100 is realized by the aforementioned attachment section 102, which is preferably clampingly accommodated in the carrying rail 10. However, all other attachment possibilities, such as screwing, latching, welding, gluing and the like are possible. In this case, the electromagnet 101 is stationarily mounted at the attachment section 102, by screws 105, one of them being visible.

The locking arrangement 1 is illustrated in a locking position. This means the latching projection 32 is in engagement with the reach-through parts 110, 120 and engages the reach-through part 110 from behind. As can be seen, the latching projection 32 and thus likewise the shaft 33 pass through the reach-through parts 110, 120, respectively their openings 111, 121, only the opening 111 of the reach-through part 110 being clearly visible in this illustration. The reach-through parts 110, 120 are disposed between the latching projection 32 and the abutment section 31.

The illustrated block arrow represents the direction of movement of the rotor 22, respectively of the carriage 20 and thus of the locking element 100 and of the latching projection 32. The carriage 20 connected thereto is thus prevented from detaching from the locking element 100, namely from moving diagonally to the bottom left in FIG. 2. Obviously, the leaf, which is operatively connected to the carriage 20, is likewise prevented from moving and is thus locked.

In the illustrated position, the abutment section 31 is preferably firmly abutting against the reach-through part 110. However, it may be provided that the shaft 33 is configured to be longer such that the abutment section 31 is able to move a certain distance away from the reach-through part 120. This is advantageous in that changes in the system, caused for example by temperature fluctuations, can be compensated for.

Furthermore, the reception sections 11, 12 are illustrated, in this case, intended for the profile 21 and the likewise not-illustrated stator of the linear motor. The reception sections 11, 12 are separated from each other, at or in the carrying rail 10, by protruding projections 13, which face each other. The surfaces of the projections 13, which face away from the leaf, serve as the support surfaces for the stator. The surfaces of the projections 13, which face the leaf, preferably serve as the support surface for the attachment section 102 of the locking element 100. In addition, at their surfaces facing the profile 21, the projections 13 serve as the running surfaces for not visible rollers of the carriage 20. This is in particular useful because it is thereby assured that a predetermined distance is always maintained between the rotor 22, respectively the reception profile 21 and the stator, such that the magnetic driving force of the thus configured linear motor is guaranteed. At the side oriented towards the non-illustrated leaf, the carrying rail 10 has furthermore projections 14 which, similarly to the projections 13, are configured to protrude and face each other. At their sides facing away from the leaf, the projections 14 may likewise serve as running surface for corresponding rollers of the carriage 20. The projections 13, 14 thus preferably serve for positioning the respective carriage 20 in the carrying rail 10.

Figure 3A:
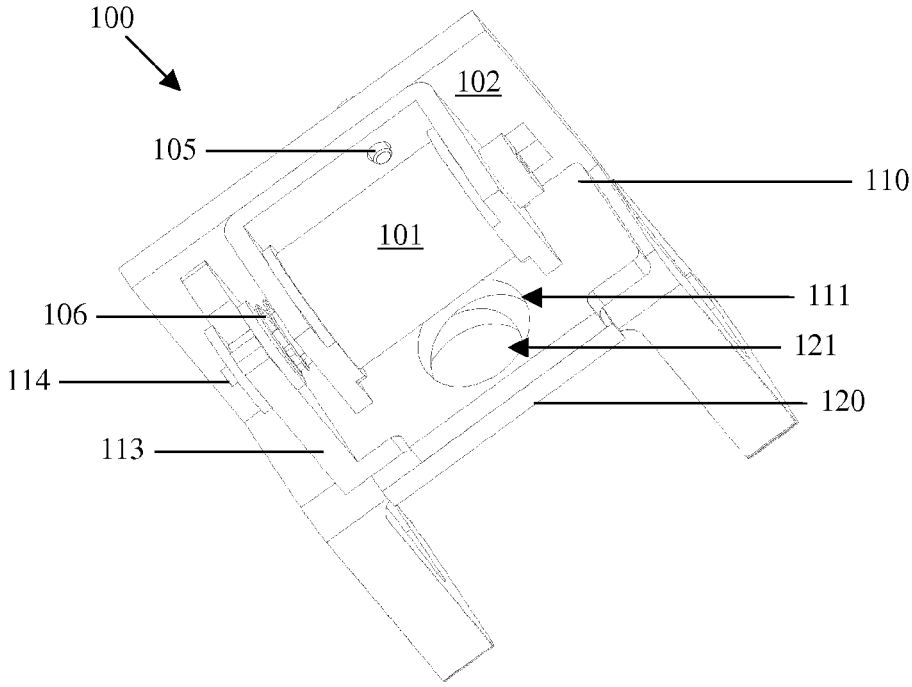
FIG. 3 is the locking element of FIG. 1 and FIG. 2 in an enlarged detail, according to a first embodiment of the invention.

FIG. 3*a* shows the locking element 100 in an enlarged detail and according to a first embodiment of the invention. The locking element 100 is illustrated in a so-called blocking position which makes the aforementioned locking position possible. The armature plate 113 has a pin-like part 114. The part 114 is preferably configured to pass through the armature plate 113. It is thereby possible to dispose for example a helical spring 106 as the return element between the armature plate 113 and the electromagnet 101. If the electromagnet 101 is not energized, the return spring 106 ensures the armature plate 113 is moved into a release position, which is not illustrated in this case. In addition, at its end remote from the electromagnet 101, the part 114 may be utilized to connect an actuating element, such as a Bowden cable, a lever, a traction rod, or the like. It is thereby also possible to utilize the locking element 100, respectively the locking arrangement 1 within a closing sequence control system with a double-leaf swing door installation. In this case, the electromagnet 101 serves to retain the inactive leaf of this installation. For releasing the latching projection 32 by the aforementioned actuating element, the part 114 is pulled by the other leaf, namely the active leaf, respectively by the actuator thereof, into the release position, in which the openings 111, 121 are preferably aligned with each other.

As can be seen, the attachment section 102 and the reach-through part 120 form a mounting bracket to which, at an interior side facing the leaf, the electromagnet 101 is attached, in this case, by screws 105. In the illustrated example, the reach-through parts 110, 120 have circular openings 111, 121 which are not aligned with each other in the illustration shown. However, in the aforementioned release position, the openings 111, 121 are aligned with each other such that the latching projection 32 can freely move through the openings 111, 121 and therefore can not be blocked nor locked. Thereby the locking element 100 is in the aforementioned release position.

If locking the aforementioned latching projection 32 is desired, the electromagnet 101 is energized, the armature plate 113 is magnetically attracted and thus the reach-through part 110 is moved into the position shown in FIG. 3*a*. In this position, the aforementioned tapered configuration of the latching head, of the latching projection 32, allows the latter to overcome both the opening 121 and the opening 111 and to engage in the opening 111 in a latching manner. In the locking position, as the openings 111, 121 are not aligned with each other, the latching projection 32 engages the opening 111 from behind and can not be removed from the openings 111, 121 or can only be moved to a very small extent out of the openings. Thereby a very simple, yet effective locking of the one connected leaf, respectively of more connected leaves is realized.

Figure 3B:
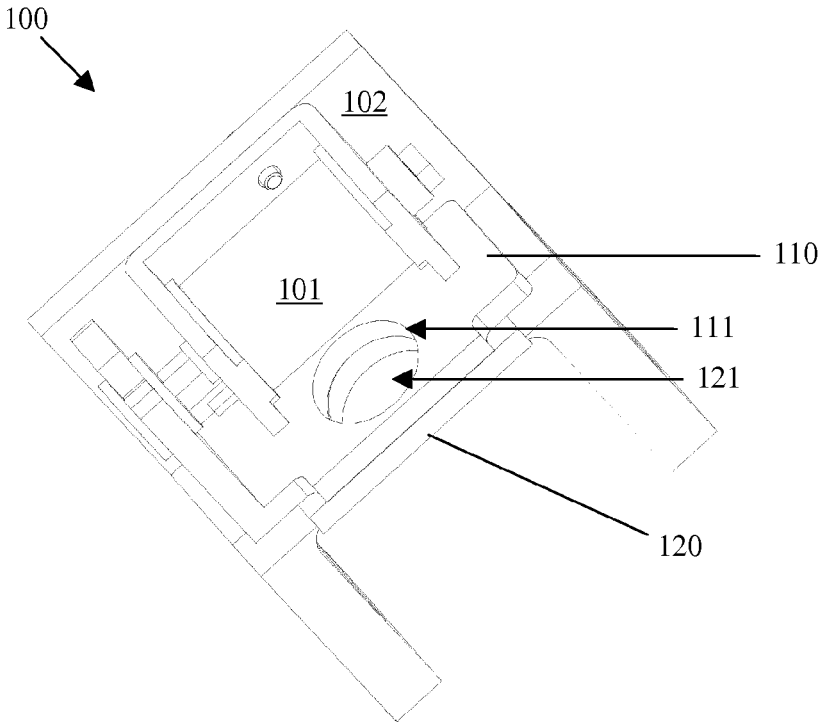

FIG. 3*b* shows the locking element 100 in a release position. As can be seen, the openings 111, 121 of the reach-through parts 110, 120 are aligned with each other. They are at least oriented towards each other in that the non-illustrated latching head 32 preferably is freely movable back and forth through the openings 111, 121. In this case, the electromagnet 101 is preferably not energized. The non-illustrated return spring 106 pushes the reach-through part 110 into the illustrated release position.

As shown, the electromagnet 101 may be configured to open, respectively to release the latching projection 32, without being energized. However, the electromagnet 101 may likewise be configured to close without being energized and thus to block the latching projection 32 in the locking position. In this case, in the working position of the electromagnet 101 shown in FIG. 3*a*, this means when it has magnetically attracted the armature plate 113, the opening 111 is configured to be aligned with the opening 121. If the electromagnet is no longer energized, the armature plate 113 is urged away from the electromagnet and the openings 111, 121 take an orientation similar to FIG. 3*a*, namely they are no longer aligned with each other.

Figure 4A:
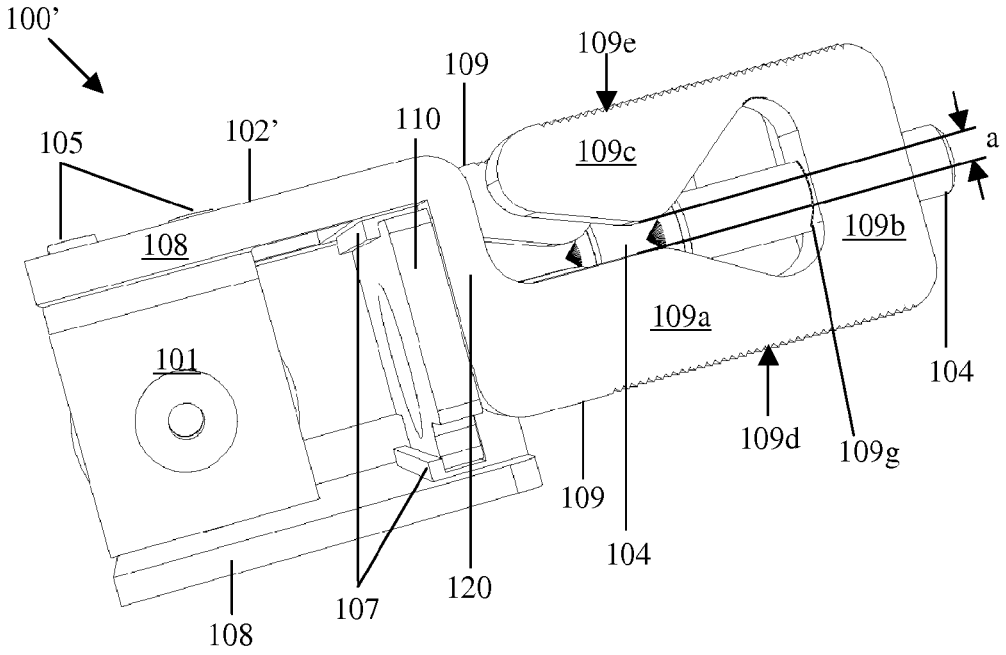
FIG. 4 is a locking element according to a second embodiment of the invention.

FIG. 4*a* shows a locking element 100' according to a second embodiment of the invention. In cross-section the attachment section 102' is configured U-shaped and thus offers a reception space for the electromagnet 101. Preferably, the electromagnet 101 is affixed to the attachment section 102' by screws 105. A wall section, connecting the two legs 108 of the U, is configured by the reach-through part 120, which by way of example is configured integrally with the attachment section 102'. At their sides facing each other, the legs 108 have guiding sections 107, in this case in the shape of projecting guiding grooves, respectively guiding rails which are open towards each other. The reach-through part 110 is accommodated in these guiding sections 107 to be guided and movable between the blocking and releasing positions, in this case back and forth substantially vertically to the plane of the sheet.

The side of the reach-through part 120 facing away from the legs 108 is adjoined by two claw-like clamping sections 109 extending in a direction away from the electromagnet 101. This means each clamping section 109 has a first wall section 109*a*, which extends from the reach-through part 120. The end of the wall section 109*a*, facing away from the reach-through part 120, is adjoined by a respective second wall section 109*b*, preferably at a right angle with the associated wall section 109*a*. Then the end of the second wall section 109*b*, facing away from the first wall section 109*a*, is adjoined by a respective third wall section 109*c*, which extends in the direction of the reach-through part 110.

Preferably, the clamping sections 109 extend parallel with regard to each other. The wall sections 109*a*, 109*c* of the clamping sections 109 are configured such that the locking element 100' can be introduced into the reception section 12 of the non-illustrated carrying rail 10. In this case, facing away from each other, surfaces 109*d*, 109*e* of the wall sections 109*a*, 109*b* are facing the respective one of the corresponding projections 13, 14 of the carrying rail 10.

Each wall section 109*b* has a through-opening 109*g* through which a clamping element is passed, in this case, in the shape of a respective screw 104. The wall sections 109*a*, 109*c* of a respective clamping section 109, at least in partial areas, have a distance a with regard to each other which is smaller than the maximum exterior diameter of the screw 104. The screws 104 however are configured such that they reach between the aforementioned areas of the associated wall sections 109*a*, 109*b* which have the distance a with regard to each other. In this case, the third wall section 109*c* is moved away from the wall section 109*a* of the respective clamping section 109, such as to increase the distance a. In this case, the surfaces 109*c*, 109*d* of said clamping section 109 reach a clamping abutment with the projections 13, 14; the locking element 100' is thus braced, respectively clamped in the carrying rail 10.

The locking element 100' thus forms a sort of module, which can be inserted as a whole into the carrying rail 10.

Instead of screws 104, respectively a spreader pin can be utilized.

Figure 4B:
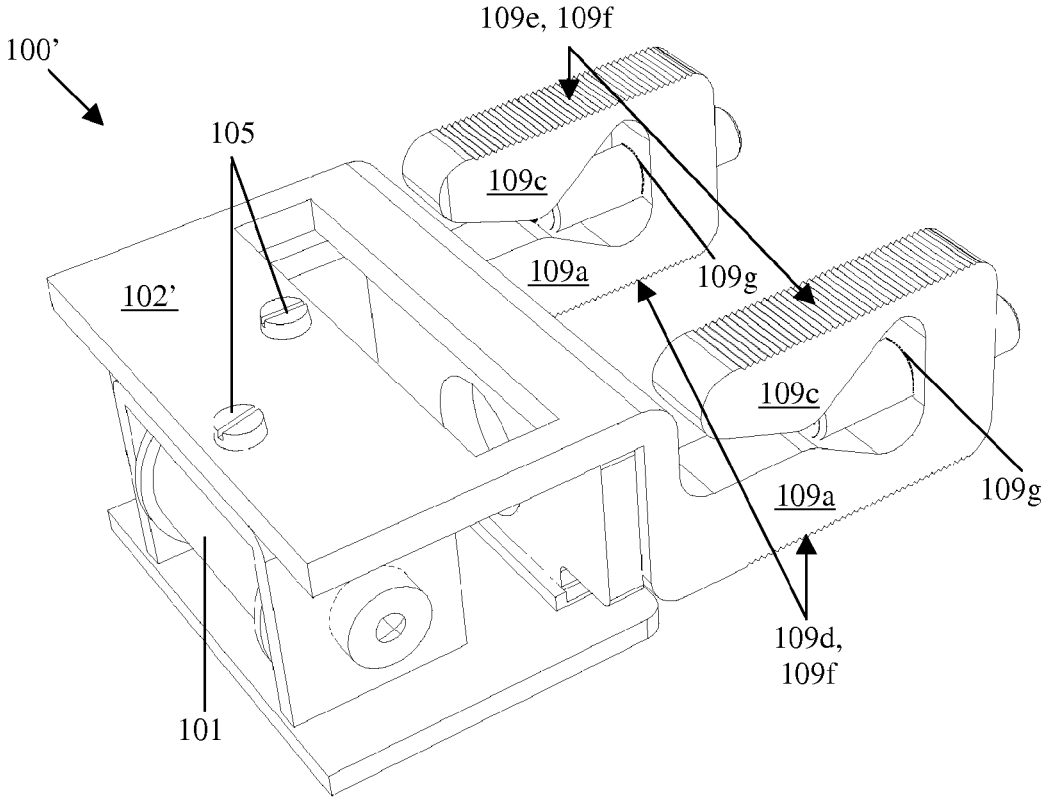

FIG. 4*b* shows the locking element 100' from a different perspective. In this case, in particular the screws 105 for attaching the electromagnet 101 to the attachment section 102 can be seen.

Preferably both surfaces 109*d*, 109*e*, again preferably of both clamping sections 109, respectively of the corresponding wall sections 109*a*, 109*c*, have slotted sections 109*f*, the slots thereof, not identified in detail, extend perpendicularly to the insertion direction in the non-illustrated carrying rail 10. If the clamping surface of the associated facing projection 13, 14 of the carrying rail 10, which clamping surface faces the respective surface 109*d*, 109*e*, has essentially complementarily configured slots, the locking element 100' can be gradually moved into the final insertion position in the carrying rail 10 and at the same time be fixed prior to bracing with screws 104 as described above, thus simplifying the installation.

Figure 5:
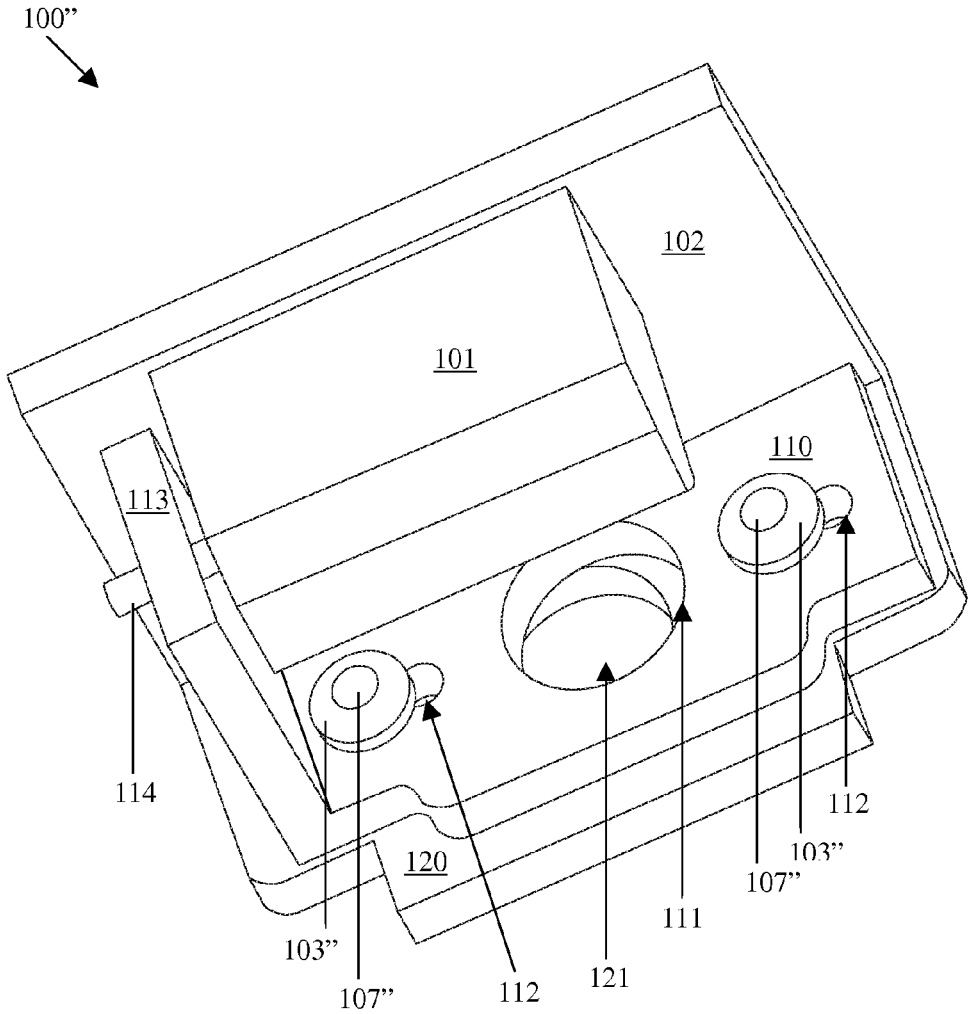
FIG. 5 is a locking element according to a third embodiment of the invention.

FIG. 5 shows a locking element 100" according to a third embodiment of the invention in the blocked position. The openings 111, 121 are not aligned with each other. The reach-through part 110 is supported in a movable manner along the actuation direction of the electromagnet 101 by oblong holes 112 via guiding pins 107", which are attached to the reach-through part 120, or are integrally configured therewith, and form a guiding section. The armature plate 113 and the reach-through part 110 preferably form an L-shaped part. The pins 107" pass through corresponding oblong holes 112 of the reach-through part 110. The oblong holes 112 thus extend along the direction of movement of the reach-through part 110.

As can be furthermore seen, retaining washers 103" are mounted to the guiding pins 107" in the area of the reach-through part 110. They prevent the reach-through part 110 from moving away or from detaching from the reach-through part 120, respectively from the guiding pins 107", which are attached thereto or are integrally configured therewith, and into the direction of the electromagnet 101. However, other solutions such as circlips, counter-nuts, or the like are possible. In the last mentioned case, the guiding pins 107" have correspondingly configured screw threads.

The reach-through part 110 is movably mounted to the attachment section 102 such that the operative connection to the electromagnet 101, the latter being likewise attached to the attachment section 102, is relieved of the weight of the reach-through part. Thus the operative connection can be accomplished in a very simple manner via the armature plate and the connecting part 114.

Preferably a lifting magnet is utilized as the electromagnet 101. As an alternative or in addition, the electromagnet 101 is configured to be bi-stable such as to accomplish both, the blocking position and the release position of the locking element 100". In this case, additional return elements can be foregone.

The part 114, in conjunction with a mechanical release component, may be utilized as well in an exemplary single leaf door, for example for an emergency opening or an emergency closing of the connected leaf. Emergency opening or emergency closing means that an opening or closing of the one respective leaf or of more respective leaves must still be possible, if the power supply of the leaf installation, in particular of the locking arrangement 1, is suspended.

As explained above, in the blocking position, the latching projection 32 bears against the surface of the opening 111 of the reach-through part 110, which part is remote with regard to the locking element 30, wherein the surface faces the locking element 100", the latching projection 32 thus engages the opening from behind and thereby locks the connected leaf. The reach-through part 120, disposed between the carriage 20 and the reach-through part 110, supports the reach-through part 110 in the direction of the carriage 20 and thus serves to guarantee the locking.

As the latching projection 32 engages the reach-through part 110 from behind which is movable perpendicularly to the direction of movement of the latching projection 32, in the blocking position, the electromagnet 101 does not have to counteract the forces of inertia of the connected leaf or of more connected leaves. The magnet just needs to develop the force which is required to maintain the latching projection 32 engaged, namely the force to keep the openings 111, 121 in the position where they are not aligned with each other. On the one hand, this force is substantially lower. On the other hand, this force is not, or only insignificantly dependent on the weight of the one connected leaf, or of more connected leaves.

As a result, the invention provides a universally applicable locking system for any type of leaf installation, which has one or more guiding rails or slide channels operatively connected to the leaf/leaves to be locked, thus namely are in operative connection with this leaf/these leaves. As only guiding rail(s) or slide channel(s) are required, the locking may be independent from the respective drive mechanism of the leaf installation.

The invention is not limited to the above described embodiments. It may be applied for example in any type of sliding leaf installations, such as sliding door installations or the like. Furthermore, it is readily applicable with swing leaf installations, as long as they are equipped with a slide channel, for example as a component of a slide arm assembly. Further fields of application are for example windows, which are likewise slide-channel guided, via a so-called scissor arm.

The reach-through part 120 may be foregone as well. In this case, guides are configured for the reach-through part 110 at the attachment section 102, for example by guiding walls extending parallel to the reach-through part 120 illustrated in this case, in which guiding walls the reach-through part 120 is guided. Instead of the circular cross-section of the openings 111, 121, obviously any other cross-sectional shape is possible. The cross-sectional shapes of the openings 111, 121 do not have to be complementary to the cross-sectional shape of the latching projection 32 seen along the movement of the latching projection 32, and they do not have to be identical with regard to each other. They may be square for example. With the openings 111, 121 not being aligned with each other in the blocking position, the latching projection 32 is still bearing against the opening 111 and is locked.

If the reach-through part 120 is utilized, in the mounting position, the opening thereof 121 is in alignment with the latching projection 32 at any time, such that the latter is always able to pass through the opening 121 without any resistance.

The locking elements 30, 100 can be disposed with their positions being exchanged, such that now the locking element 100 is moved along with the carriage 20, but in any case corresponding to the movement of the connected leaf.

The Figures show a locking arrangement 1, in which a locking element 100 is disposed at an end of the carrying rail 10. By way of example, the position of the leaf, locked by the locking arrangement 1, corresponds to a closed position of this leaf. As an alternative or in addition, another locking arrangement may be provided which is disposed in the carrying rail 10 in such a way that said leaf is locked in the opened position, namely that it serves as a hold-open device. This is for example useful in shops, where the entrance door should remain open for the public to pass through.

According to FIGS. 1 and 2, the locking element 30 is fitted to the frontal side of the reception profile 21. It may also be configured to be inserted, respectively to be introduced into the reception profile 21, analogously to the locking element 100 with regard to the carrying rail 10.

Instead of an electromagnet 101, for example a motor with a drive pinion can be utilized, which meshes with a toothed rack, which preferably is a component of the reach-through part 110. Thus, it is possible to change between the release position and the blocking position only in a motor-driven manner. Furthermore, manual or other automatic adjusting possibilities for changing between blocking position and release position are possible.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A device for locking at least one leaf of a leaf installation, the device comprising:

a first locking element comprising a first latching element at an end of the first locking element; and a second locking element adapted to be stationarily disposed relative to the leaf installation and comprising a second latching element at an end of the second locking element facing the first latching element, the second latching element being configured to be brought into a latching and operative engagement with the first latching element;

wherein the first locking element is adapted to move correspondingly to a movement of the at least one leaf, whereby the first locking element is moved translationally into one of a locking position towards the second locking element and an unlocking position away from the second locking element; and wherein one of the first and second locking elements comprises an activating element, which is operable between a blocking position to allow the latching and operative engagement of the first and second latching elements and a release position to prevent the latching and operative engagement, wherein one of the first and second latching elements has a latching projection, and wherein the other of the first and second latching elements has a latching part corresponding to the latching projection, wherein the latching part comprises a first reach-through part, which has a first latching opening extending end-to-end in the first reach-through part and is movable at one of an acute and right angles with regard to a translational path of movement of the latching projection;

wherein, in the release position, the first latching opening is positioned to allow the latching projection to freely move through the first latching opening along the translational path of movement of the latching projection; and wherein, in the blocking position and as long as the latching projection passes through the first latching opening in the locking position, the first latching opening is positioned to, at least to a predetermined degree, prevent the latching projection from moving away from the first latching opening into a direction of the first locking element, so that the latching projection is in the latching and operative engagement with the first latching opening while latching the latching projection from behind.

2. The device according to claim 1, wherein the first locking element is configured to be stationarily mounted in an area of a reception groove of a guiding part of the at least one leaf, which is stationarily disposed with regard to one of the leaf installation and the at least one leaf.

3. The device according to claim 1, wherein the latching part comprises a second reach-through part, which is disposed at a side of the first reach-through part facing the latching projection, has a second latching opening extending end-to-end in the second reach-through part, and is stationarily disposed with regard to the second locking element, such that the latching projection is freely moveable back and forth through the second latching opening along the translational path of movement of the latching projection.

4. The device according to claim 3, wherein the first and second reach-through parts bear against each other.

5. The device according to claim 1, wherein the latching projection has an end facing the first latching opening in a direction of the first latching opening and having one of a tapering shape and a mushroom head-shape.

6. The device according to claim 1, wherein the activating element comprises an electromagnet, which, when activated, moves the first reach-through part into one of the release position and the blocking position.

7. The device according to claim 3, wherein the latching projection has an end facing the first latching opening in a direction of the first latching opening and having one of a tapering shape and a mushroom head-shape.

8. The device according to claim 4, wherein the latching projection has an end facing the first latching opening in a direction of the first latching opening and having one of a tapering shape and a mushroom head-shape.

9. The device according to claim 3, wherein the activating element comprises an electromagnet, which, when activated, moves the first reach-through part into one of the release position and the blocking position.

10. The device according to claim 4, wherein the activating element comprises an electromagnet, which, when activated, moves the first reach-through part into one of the release position and the blocking position.

11. The device according to claim 5, wherein the activating element comprises an electromagnet, which, when activated, moves the first reach-through part into one of the release position and the blocking position.

* * * * *